United States Patent [19]

Meyer

[11] Patent Number: 4,475,924

[45] Date of Patent: Oct. 9, 1984

[54] COAL DERIVED FUEL COMPOSITION AND METHOD OF MANUFACTURE

[75] Inventor: Edmond G. Meyer, Laramie, Wyo.

[73] Assignee: Meyer Trust, Laramie, Wyo.

[21] Appl. No.: 427,937

[22] Filed: Sep. 29, 1982

Related U.S. Application Data

[63] Continuation-in-part of Ser. No. 247,382, Mar. 24, 1981, abandoned.

[51] Int. Cl.[3] ..... C10L 1/32

[52] U.S. Cl. ..... 44/51; 44/1 R; 44/1 SR; 406/47

[58] Field of Search ..... 44/1 R, 1 SR, 51

[56] References Cited

U.S. PATENT DOCUMENTS 4,014,661 3/1977 Hess et al. ..... 44/51
4,030,893 6/1977 Keller ..... 44/1 SR
4,192,651 3/1980 Keller ..... 44/1 SR
4,208,251 6/1980 Rasmussen ..... 44/51

OTHER PUBLICATIONS

Kirk-Ottmer Encyclopedia of Chemical Technology, 2nd Edition, vol. 4, p. 420.

*Primary Examiner*—Jacqueline V. Howard
*Attorney, Agent, or Firm*—Lee G. Meyer

[57] ABSTRACT

Coal char produced by the pyrolytic destructive thermal distillation of coal in the absence of oxygen is beneficiated, ground and sized and then is admixed in suitable portions with a liquid organic fraction to form a combustible, liquid-solid mixture which is a nonpolluting, stable, transportable, high energy fuel composition. Preferably, the liquid organic fraction is obtained from the low boiling fractions derived from the pyrolysis of coal.

11 Claims, 1 Drawing Figure

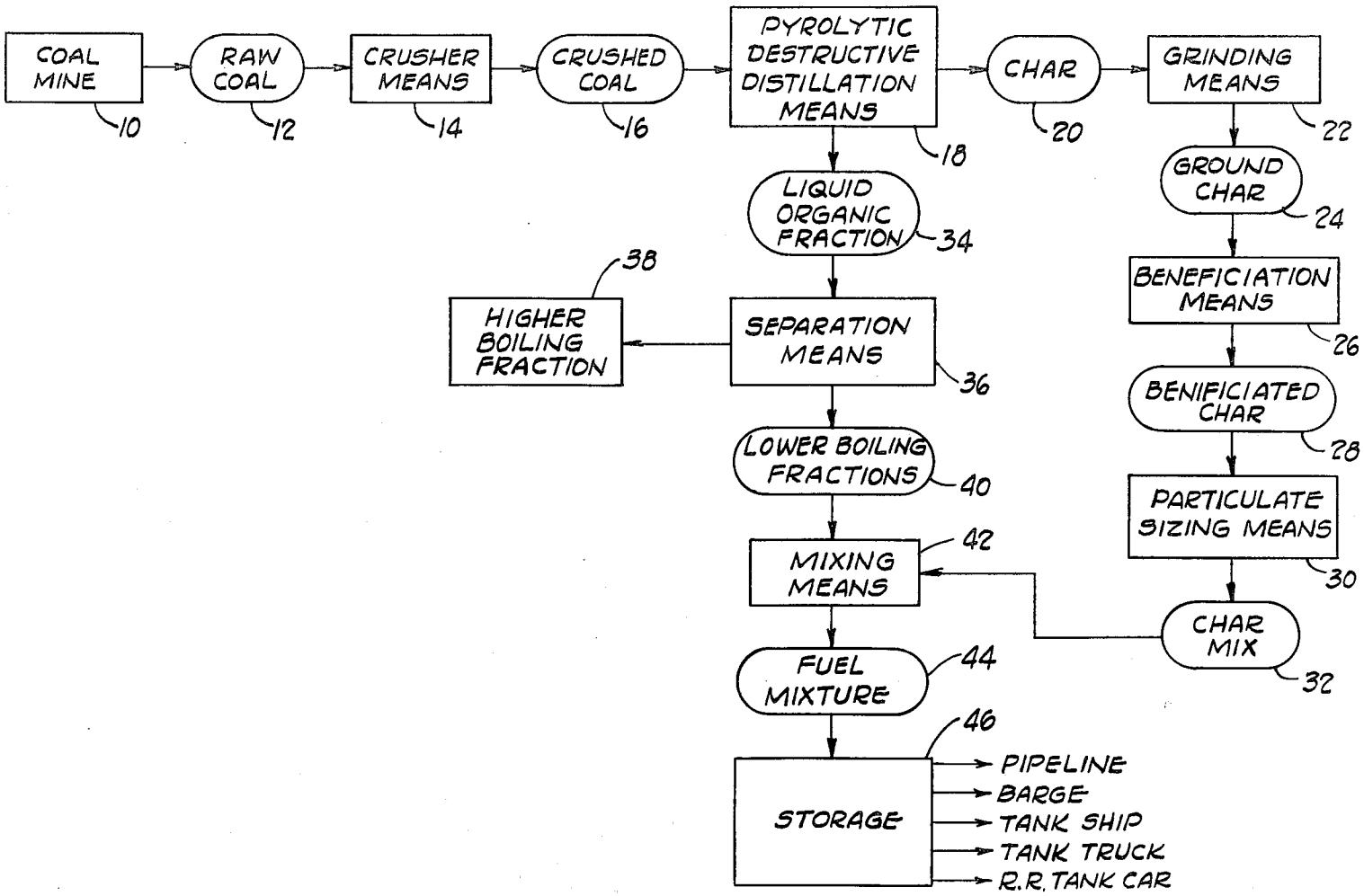
COAL MINE
10
RAW COAL
12
CRUSHER MEANS
14
CRUSHED COAL
16
PYROLYTIC DESTRUCTIVE DISTILLATION MEANS
18
CHAR
20
GRINDING MEANS
22
GROUND CHAR
24
BENEFICIATION MEANS
26
BENIFICIATED CHAR
28
PARTICULATE SIZING MEANS
30
CHAR MIX
32
LIQUID ORGANIC FRACTION
34
SEPARATION MEANS
36
HIGHER BOILING FRACTION
38
LOWER BOILING FRACTIONS
40
MIXING MEANS
42
FUEL MIXTURE
44
STORAGE
46
PIPELINE
BARGE
TANK SHIP
TANK TRUCK
R.R. TANK CAR

COAL DERIVED FUEL COMPOSITION AND METHOD OF MANUFACTURE

TECHNICAL FIELD

This application is a continuation-in-part of U.S. patent application Ser. No. 247,382 filed Mar. 24, 1981, now abandoned. This invention relates to improved compositions and methods for making available to populous areas carbonaceous fuel supplies, such as coal, which are located in remote areas. More particularly, this invention relates to high energy, non-polluting, transportable fuel compositions which contain coal char and methods of making such compositions.

BACKGROUND ART

Over 200 billion tons of economically recoverable coal exists in this country. This represents enough to last the United States for at least three centuries at the current consumption rate. It has been estimated that coal could provide as much as one-half of the new energy sources required between now and the year 2000. Even though coal represents 60% of our domestic fossil energy resources, it currently supplies less than 20% of all of our energy production. A number of factors have combined to create this disparity. Even with the abundance of coal energy it has not heretofore been competitive with, nor as easily utilized as, hydrocarbon containing fuels such as oil, natural gas and the like.

One important use of our coal resource is stationary power conversion facilities such as plants producing electricity or process heat which do not require the scarce liquid and gaseous hydrocarbon fuels. Stationary power conversion facilities can operate using coal leaving the liquid and gaseous hydrocarbon fuels to transportation and certain residential/commercial uses. Use of coal in stationary power facilities requires either transportation of the solid fuel to the power facility or utilization of the solid fuel at the mine site. Utilization at the mine site to produce electricity is not always efficient due to transmission and/or conversion losses. Production of electrical energy at other than the mine site requires transportation of the coal. Coal is currently shipped by rail in unit trains. However the required handling is cumbersome, wasteful and expensive. The current rail capacity is inadequate to move the tonnage required to supplant existing use of more costly and scarce liquid fuels.

A further attendant problem with the use of solid fuels generally, and coal specifically, is that not all solid fuels contain the same mixture of constituents. For example western coal, while being low in sulfur, is also low in BTU per unit weight and has a high water content. Eastern coal on the other hand has higher sulfur and BTU content per unit weight but lower water. Each requires specific pollution control equipment and a certain boiler system. Therefore, coal is not as uniform a fuel as is, for example, #6 fuel oil or the like.

Additionally, coal from whatever source contains various pollutants which heretofore have been difficult or impossible to remove. The nature and amount of these depends upon the geographical area from which the coal is mined. Ash, sulfur, and nitrogen comprise the most objectionable of these pollutants.

Recently developed process technology permits the conversion of coal to synthetic liquid or gaseous fuels at the mine site. While this "synfuel" is more easily transported than coal, the conversion process is capital intensive and requires a great deal of water. Despite the high processing costs, the resultant synfuel, like crude oil derived fuels, is valuable as a transportation fuel.

In addition to being useful as transportation fuels, hydrocarbon containing fuels, including synfuels, are likewise valuable as feedstock for the manufacture of chemical synthetics including all types of plastics, elastomers, resins, polymers and the like. It would therefore appear advantageous to utilize coal for stationary energy needs while utilizing the liquid crude supply and synfuels for transportation as well as feedstock purposes.

In order to move coal over long distances, methods have been proposed for creating so-called "coal slurries" which comprise a pulverized, comminuted or ground coal admixed with water, and which may contain various additives to, for example, increase the wetability of the coal. This slurry, while capable of being transmitted by pipeline, requires special pipelines and pumping equipment. Aqueous coal slurries have additional drawbacks. First the water which is necessary to slurry the coal is in short supply at the geographic region of the western coal reserve. Second, water must be removed from the slurry prior to introduction of the fuel into a furnace or boiler.

Non-aqueous or hydrocarbon containing liquid can also be used as the transmission medium to form a slurry of pulverized coal. These slurries still have attendant problems. Nonaqueous coal slurries also require special pipelines and pumping equipment. Since coal is still the main fuel constituent in such slurries, furnace and stack modifications are still required to burn coals from different regions. Non-aqueous fractions, unlike aqueous solutions, tend to solubilize constituents as well as impurities in the coal. This renders the slurrying liquid substantially unusable as a feedstock for many chemical syntheses. Additionally, burning of the slurry mixture results in emission of the pollutants present in the coal. Examples of such slurries are found in U.S. Pat. No. 4,030,893 issued to Keller on June 21, 1977 and U.S. Pat. No. 4,192,651 issued to Keller on Mar. 11, 1980.

Another suggested slurry system was proposed by Rasmussen as disclosed in U.S. Pat. No. 4,208,251 issed June 17, 1980. In this process coal is heated in a coking oven at suitable coking temperatures to produce coke, which is then admixed with some of the liquefied, liberated volatile materials produced during coking. While solving one of the inherent problems with the coal-containing slurries, the coke slurry has a number of attendant drawbacks which make it highly undesirable for commercial application. Coke, while a solid carbon product like coal and lampblack, is generally of such a size (20 to 80 millimeters) as to not be conducive to high loading as required in slurry transport systems. Further, coke is an agglomerated product of substantially low reactivity, high pore diameter, low surface area and is more or less cubical in shape. Because coke has a size generally in the 20 to 80 millimeter range and is cubical in shape, it does not lend itself to efficacious loading in slurry systems. Therefore, the solid combustible material delivered to the ultimate destination for combustion is greatly reduced. Although coke's substantially cubical shape is effective as a structural strata in blas furnace operations, it greatly impedes the coke-containing slurry's "pumpability". Additionally, coke has a very large pore diameter which absorbs liquid in the slurry system, requiring the use of more liquid for a given amount of solid and further reducing the pumpability. Further, coke inherently has a lower surface area and reactivity which reduce its effectiveness as a fuel.

Thus it would be highly advantageous to have a fuel mixture easily prepared from coal which would be transportable using existing pipeline systems; burnable in substantially all existing boiler systems with little or no modification regardless of the region from which the solid fuel was obtained; high in BTU content per unit volume; and low in ash, sulfur and nitrogen pollutants.

DISCLOSURE OF THE INVENTION

It has been discovered that an admixture of a particulate coal char and a liquid organic fraction yields a transportable fuel composition which has high BTU per unit volume, is low in pollutants, and is a universal fuel for all boilers with little or no modification. In the broad aspect of the invention a liquid-solid mixture includes a particulate coal char portion dispersed in a liquid organic fraction to create a composition which has fluidic characteristics such that it can be transported by certain existing pipeline facilities. The liquid organic fraction which acts as a continuous phase in the admixture does not contain the impurities of the prior art slurries and thus is capable of being separated from the liquid-solid mixture prior to the ignition of the char. The separated liquid is then available for use as a feedstock for synthesis of chemical compounds.

Economically, the liquid organic fraction is derived during the pyrolysis of the coal. Advantageously both the char and the liquid organic fraction are beneficiated. The fuel composition of the instant invention can be produced by subjecting coal to pyrolytic destructive distillation in the absence of oxygen to produce a particulate char which is admixed in suitable proportions with a liquid organic fraction to produce a liquid/solid fluidic mixture. In this manner precious reserves of water in western coal region are very efficiently and effectively utilized.

In accordance with one aspect of the invention the combustible liquid-solid mixture is produced by first subjecting coal to pyrolytic destructive thermal distillation in the absence of oxygen to produce a coal char. The char is then pulverized or otherwise ground to yield the particulate matter. The particulate matter is then beneficiated to produce a substantially pollutant-free char material. The lower boiling organic fraction obtained from the pyrolysis of coal is admixed with the particulate beneficiated char in proportions so as to form the fluidic, solid-liquid, combustible fuel mixture. Advantageously, the lower boiling organic fraction used does not contain sulfur or nitrogen pollutants. In accordance with another embodiment, the beneficiated particulate char is admixed with a lower chain alcohol which is produced by well known synthetic methods utilizing coal and water or natural gas.

The utilization of char allows a high packing of the solid particulate matter for a given fluidity of the mixture. Thus not only does one obtain the aforementioned advantages but the energy requirement necessary to pump a single BTU of fuel energy is significantly reduced. In a further advantageous embodiment the ground, beneficiated char is sized to yield a particulate distribution which is bi-modal or tri-modal. The use of a bi-modal or tri-modal particulate char distribution greatly enhances the packing of the solid.

BRIEF DESCRIPTION OF THE DRAWINGS

FIG. 1 is a flow diagram of the process of the instant invention.

BEST MODE FOR CARRYING OUT THE INVENTION

Turning now to the drawing there is shown a schematic of process steps for producing a coal derived fuel composition of the instant invention wherein raw coal 12 from a coal mine 10 is conveyed continuously to a crusher means 14. Within crusher means 14 the raw coal 12 is fragmented to particles in the range of ½" to ¼" in diameter to produce a crushed coal product 16. The crushed coal 16 is conveyed continuously to a pyrolytic destructive distillation means 18 which preferable contains a preheating chamber to remove moisture and entrained gases. The pyrolytic destructive distillation means 18 provides for thermal destructive distillation of the coal in the absence of oxygen to produce a char portion 20 and a liquid organic fraction 34. The char portion 20 is continuously conveyed to a grinding means 22. Within the grinding means 22 the char is pulverized or otherwise comminuted to produce a ground char product 24 which is efficacious for bimodal and trimodal packing because it is inherently spherical in shape. The ground and sized char 24 is conveyed to a beneficiate means 26. Within the beneficiation means 26 the ground char 24 is beneficated by removal of undesirable constituents and pollutants such as sulfur and ash. The open pore structure of the char facilitates this process. The beneficiated char 28 is conveyed to a particulate sizing means 30. Within the sizing means 30 the particulate is mechanically separated by particle size to produce a sized distribution of particulate char. The sized char mixture 32 is continuously conveyed to a mixing means 42.

The liquid organic fraction 34 is conveyed from the pyrolytic destructive distillation means 18 to a separation means 36 where the higher boiling fraction 38 containing the bulk of the nitrogen is separated for example by distillation from the remainder and conveyed to storage for use directly as a chemical reagent and feed stock. Within the separation means 36, the lower boiling fraction 40 is rendered substantially free of combined and entrained materials which on combustion would produce sulfur oxides, nitrogen oxides, the like pollutants. The lower boiling, pollutant free fraction 40 is continuously conveyed to the mixing means 42. Within the mixing means 42 the char mixture 32 and the liquid lower boiling fraction 40 are combined in appropriate proportions to produce the easily transportable char containing fuel composition 44 of the instant invention which is passed to storage 46 for distribution by pipeline or tanker vehicle in a manner similar to crude oil.

The coal that can be employed in accordance with the instant invention can be generally termed "combustible carbonaceous material". It is any of the combustible, carbon containing materials that will undergo pyrolytic destructive distillation to form char. Such materials comprise carbon containing shales, anthrasite coal, bituminous coal, and all of the soft coals, lignites, and the like.

The mining and preparation of coal is fully described in Kirk-Othmer ENCYCLOPEDIA OF CHEMICAL TECHNOLOGY, second edition, Anthony Standin, editor, Interscience Publishers, New York, 1969, vol. 5, pp. 606–676. The coal is mined from a coal mine by either strip or underground methods as appropriate and well known in the art.

The raw coal material 12 is preferable subjected to preliminary crushing to reduce the particle size. Particle sizes of from ½" to about ¼" in lateral dimension (diameter) are found useful, with particles of about ⅜" being preferred. The need for size reduction and the size of the reduced material will depend upon the pyrolytic conditions utilized as well as the composition of the coal material. The crushing and/or grinding is preferably accomplished with impact mills such as counter-rotating cage mills, hammer mills or the like. This is done to impart an impact type shock to the coal to separate material along natural planes, faulted surfaces, solution channels and the like. Within the crusher means 14 the coal is sized by, for example, rough screening and gangue material is removed to assure a more uniform product for pyrolysis. Advantageously, carbonaceous fines and the like are readily utilized and can be separated from the macro coal particles and conveyed directly to the pyrolytic destructive distillation means 18. The macro coal particles are passed continuously through a preheater within pyrolytic destructive distillation means 18 which is operated at 150° to 220° F. in order to remove gases and moisture. This is a well known process and is of value in that the BTU content of the resultant coal per unit weight is increased. This preheating also removes certain entrained gases which may have further value as fuel for the pyrolysis step.

The pyrolytic destructive distillation means 18 can be any pyrolysis apparatus which is well known in the art having the ability to reach charring temperatures in the requisite time, for example temperatures in the range of about 600° C. to about 1000° C. and having a heating rate of from about 1.5° C. per second to about 2.5° C. per second. It will be realized by the skilled artisan that, depending on the composition of the charge, the residence time and the charring furnace utilized, temperatures and rates may vary. Preferably, the pyrolysis is performed in a continuous process. As the crushed coal 16 is heated in the absence of oxygen, the entrained materials are vaporized and collected. Lower boiling organic fractions including hydrocarbons, cyclics, and aromatics as well as higher boiling organic fractions are emitted from the coal leaving a char material of essentially carbon which is of a porous structure and substantially spherical in shape. Included in the emitted constituents are the nitrogen containing polluting compounds such as pyridine, piperazine and the like.

The char 20 is continually conveyed to the grinding means 22. The char material may be emitted from the charring apparatus as "lumps" of discrete particles which are stuck together depending on the charge and the pyrolysis conditions utilized. Therefore the char material is placed through grinding means 22 to break up this mass of material to yield the substantially spherical particulate coal char. The grinding means 22 reduces the char to a suitable fineness to facilitate beneficiation and subsequent sizing for use in the fuel admixture. Any conventional crushing and grinding means, wet or dry, may be employed. This would include ball grinders, roll grinders, rod mills, pebble mills and the like. Advantageously, the particles are sized within the grinding means 22 and recycled to produce a uniform distribution of particles. The char particles are of sufficient fineness to pass a 10 mesh screen and the majority of the particles are in the 100 to 200 mesh size. The mesh sizes refer to the Tyler Standard Screens. The char 24 is continuously conveyed to the beneficiation means 26.

The beneficiation means 26 can be any device known in the art utilized to extract pollutants and other undesirable inorganics such as sulfur and ash from a particulate char material. Char 20, unlike coal, has a high degree of porosity which enables it to be easily beneficiated. This can be done for example, by washing, jigging, extraction, flotation, chemical reaction, and/or electrobeam techniques. The exact method employed will depend largely on the coal constituent utilized in forming the char, the sizes of the char particles and the conditions of pyrolysis.

The chars which can be utilized in accordance with the instant invention have a high reactivity and surface area, providing excellent Btu to weight ratios. They are highly porous to facilitate beneficiation and combustion but the pore size is not so large as to require the use of additional liquid for a given amount of solid. The spherical shape allows adjacent particles to "roll over" one another, therefore greatly reducing slurry viscosity while greatly enhancing the solid loading characteristics. Preferably, chars that can be employed typically have a reaction constant of from about 0.08 to about 1.0; a reactivity of from about 10 to about 12; surface areas of from about 100 microns to about 200 microns; pore diameters of from about 0.02 milimicrons to about 0.07 milimicrons; and, spherical particles with diameters in the range of from about 10 to about 100 microns.

The beneficiated char 28 is sized in particulate sizing means 30 which can be any apparatus known in the art for separating particles of a size in the order of 100 microns. Economically, screens or sieves are utilized, however cyclone separators or the like can also be employed. In sizing selections made so as to assure combustion, a second and/or third particle size is chosen to effect so called "modal" packing. The spheriod shape of the primary particle provides spacing or voids between adjacent particles which can be filled by a distribution of second or third finer particle sizes to provide bi-modal or tri-modal packing. This packing concept allows the compaction of substantially more fuel in a given volume of fuel mixture while still retaining good fluidity.

The resultant char mix 32 is conveyed by means of for example an air conduit to the mixing means 42 where it is combined in appropriate proportion with the lower boiling organic fraction 40.

Simultaneously, with the preparation of the char, the organic fraction 34 entering the separation means 36 is continuously fractionally distilled or otherwise separated to provide the lower boiling pollutant free organic fraction 40. The exact amount of this fraction utilized will depend upon the properties of the combustible char containing admixture which are desired. Normally, fractions having boiling points up to about 200° F. have been found useful in carrying out the instant invention. Any remaining pollutant fraction could be separated by other means as, for example, steam stripping.

The higher boiling fractions 38 of the liquid organic fraction 34 advantageously contain certain sulfur and nitrogen compounds. This fraction is removed and can be used directly as a feedstock for chemical synthesis. Alternatively, it can be hydrotreated by methods well known in the art to reduce the viscosity and thus can be used as additional slurry liquid. Advantageously, this hydrotreating can be accomplished during the pyrolysis step.

Within the mixing means 42 the particulate char and the lower boiling pollutant-free organic fraction 40 are admixed in the desired portion and sent to storage 46. In the mixing means, an admixture is formed of char and the liquid constituent. The ratio of char to liquid that can be utilized will depend upon the properties of the fuel desired. For most applications the char constituent should comprise not less than about 45% by weight of the composition and preferably from about 45% to about 75% by weight. The mixing means 42 can be any well known mixing apparatus in which an organic constituent and a coal char can be mixed together in specific proportion and pumped continuously to a storage tank such as 46.

Certain well known surfactant stabilizers may be added depending on the viscosity and non-settling characteristics desired. Within the storage tank 46 it is generally not required to agitate the fuel admixture of the instant invention unless such storage is to be for an extended period. From the storage tank the fuel of the instant invention is preferably continuously conveyed by means of pipelines well known in the art to distant fixed source heat and electric generators.

It will be realized that the liquid organic fraction 34 derived from the pyrolytic destructive distillation of coal can be utilized directly as a feedstock for chemical synthesis, transportation fuels or the like rather than as the liquid phase of the instant fuel admixture.

In accordance with another embodiment of the instant invention coal and water are utilized to produce first CO and $H_2$ and then methanol and other lower alcohols which are utilized as the liquid phase for the combustible fuel admixture of the instant invention. Water released from the coal during preheating can be used as part of the water required in the synthesis, thus further preserving precious resources.

As used herein the term alcohol is employed to mean alcohols which contain from 1 to about 4 carbon atoms. These include for example, methanol, ethanol, propanol, butanol and the like. The alcohol may range from substantially pure methanol to various mixtures of alcohols as are produced by the catalyzed reaction of synthesis gas or natural gas. Advantageously, the alcohol constituent can be produced on site at the mine in conjunction with the pyrolytic destructive distillation. The process can be fired by coal, thereby negating the necessity to transport fuels long distances.

In accordance with the process for making these alcohols directly from coal and steam, carbon monoxide and hydrogen are initially formed in accordance with equation I:

$$\text{HOH (steam)} + \text{C (coal)}\ \text{CO} + H_2. \qquad \text{I.}$$

A portion of the gas is subjected to the shift reaction with steam to produce hydrogen for hydrogen enrichment in accordance with equation II:

$$\text{CO} + \text{HOH (steam)}\ CO_2 + H_2. \qquad \text{II.}$$

The $CO_2$ is scrubbed from the gaseous product leaving only hydrogen. The hydrogen is admixed with gaseous products of equation I to produce a "syn gas" having desired ration of hydrogen to carbon monoxide from which methanol and similar products are synthesized catalytically.

In the methanol synthesis plant the respective constituents such as carbon monoxide and hydrogen are combined to produce methanol. The synthesis of methanol is described in page 370–398 of vol. 13 of the above referenced KIRK-OTHMER ENCYCLOPEDIA. The carbon monoxide and hydrogen are controlled in a ratio and temperature pressure combination to obtain maximum yields of the methanol fuel product. Other methods for methanol synthesis at lower temperatures and pressures are also known, as for example, the ICI low pressure process as described in "Here's how ICI Synthesizes Methanol at Low Pressure" Oil and Gas Journal, vol. 66, pp. 106–9, Feb. 12, 1968. In accordance with this aspect of the instant invention, the methanol is used as the liquid phase to slurry the char 32 in mixing means 42.

It will be realized that in accordance with the instant invention surfactants, suspenders, organic constituents and the like may be added depending on the particular application. As hereinbefore mentioned, advantageously the admixture of the instant invention demonstrates high fluidity. Thus high BTU per unit volume are obtained with lower viscosities and higher fluidities.

It will be realized that the lower boiling organic fraction and/or the synthesized methanol will not dissolve or otherwise solubilize impurities since the coal has been charred and the char has been beneficiated. Thus the liquid phase of the composition can be readily extracted at the fuel mixture destination for use as a chemical synthesis feedstock. Additionally the fuel composition of the instant invention can be mobilized or transported by all conventional means used for crude oil transportation, permitting the efficacious foreign export of coal derived fuels which has not heretofore been readily and easily accomplished. For example the existing pipelines to docks and tanking facilities can readily be utilized. Oil tankers can empty their crude oil load in this country, and be refilled with the char containing composition of the instant invention which can be exported to other nations, thus improving the balance of payments of this country.

The liquid solid admixture, upon reaching its ultimate destination, may be employed directly as a fuel for heating; for utilities such as power plants; or for process converters such as in the preparation of synthetic materials. On the other hand it may be separated into its constituents, char and the lower boiling organic fractions and/or methanol. The char portion is employed as fuel, while the organic fraction and/or methanol can be employed as a feedstock or as a transportation fuel such as a gasoline additive or as an extender.

While the invention has been explained in relation to its preferred embodiment it is understood that various modifications thereof will become apparent to those skilled in the art upon reading the specification and it is intended to cover such modifications as fall within the scope of the appended claims.

I claim:

1. A fuel composition comprising a liquid-solid admixture including a portion of a particulate coal char material derived from coal dispersed in an amount of liquid organic material effective to produce a fluidic, combustible, transportable composition wherein said liquid organic fraction is at least partially derived from the pyrolytic destructive distillation of coal; or, is a lower chain alcohol of from 1 to about 4 carbon atoms, or mixtures thereof.

2. The fuel composition of claim 1 wherein said coal char is produced by the pyrolytic destructive distillation of coal in the absence of oxygen.

3. The fuel composition of claims 1 or 2 wherein the ratio of particulate material to liquid is not less than about 45% by weight.

4. The fuel composition of claim 1 or 2 wherein the char is beneficiated and the liquid organic fraction is substantially free of sulfur and nitrogen pollutants.

5. The fuel composition of claim 4 wherein said lower chain alcohol is produced by the catalyzed reaction of synthesis gas or natural gas.

6. A method of producing a fuel composition comprising the steps of admixing a particulate coal char derived from coal with an amount of liquid organic material effective to produce a fluidic, transportable, combustible composition wherein said coal char is produced by pyrolytic distillation of coal and said liquid organic material is derived in substantial part from the pyrolytic destructive distillation of coal or is a lower chain alcohol of from 1 to about 4 carbon atoms, or mixtures thereof.

7. A method of producing a combustible fuel composition comprising the steps of:

(a) subjecting coal to pyrolytic destructive thermal distillation in the absence of oxygen to produce a particulate coal char, and an organic liquid fraction;

(b) reducing the char to a sized particulate to effect bimodal or trimodal packing;

(c) beneficiating the particulate to produce a substantially pollutant free beneficiated particulate char;

(d) separating the organic liquid fraction into an upper boiling pyrolysis fraction which contains sulfur and nitrogen compounds and a lower boiling pyrolysis fraction which is substantially free from such sulfur and nitrogen compounds;

(e) admixing the beneficiated particulate char and an organic liquid selected from the group consisting of the lower boiling pyrolysis fraction, lower chain alcohols and mixtures thereof in proportions such that the particulate char is no less than about 45% by weight.

8. A fuel composition comprising a liquid solid admixture including a portion of a particulate coal char material derived from coal, dispersed in an amount of a liquid organic material effective to produce a fluidic, combustible, transportable composition wherein said particulate coal char is produced by the pyrolytic destructive distillation of coal in the absence of oxygen and wherein said liquid organic material is at least partially derived from said pyrolytic destructive distillation.

9. The fuel composition of claim 8 wherein said particulate material is of the order of 100 microns in size, being substantially spherical in shape.

10. The composition of claim 9 wherein the ratio of particulate material to the liquid is not less than about 45% by weight.

11. A process for producing a fuel composition comprising the steps of slurrying an effective amount of a particulate coal char with a liquid organic material to produce a fluidic, transportable, combustible composition wherein the particulate coal char is derived from the pyrolytic destructive distillation of coal in the absence of oxygen and the liquid organic fraction is at least partially derived from said pyrolytic distillation.

* * * * *